US007136498B1

(12) United States Patent
Schott

(10) Patent No.: US 7,136,498 B1
(45) Date of Patent: Nov. 14, 2006

(54) LOUDSPEAKER HAVING A DUAL CHAMBER ACOUSTICAL ENCLOSURE WITH TWO EXTERNAL VENTS AND ONE INTERNAL VENT

(75) Inventor: Wayne M. Schott, Seymour, TN (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 541 days.

(21) Appl. No.: 09/464,867

(22) Filed: Dec. 16, 1999

(51) Int. Cl.
*H04R 1/02* (2006.01)

(52) U.S. Cl. ..... 381/351

(58) Field of Classification Search ..... 381/337, 381/338, 345, 346, 351, 352, 573; 181/160, 181/144, 148, 150, 154, 156, 163, 199, 198, 181/185, 186

See application file for complete search history.

(56) References Cited

U.S. PATENT DOCUMENTS

| | | | | |
|---|---|---|---|---|
| 3,876,843 | A * | 4/1975 | Moen | |
| 4,027,116 | A * | 5/1977 | Nakamura | |
| 4,549,631 | A | 10/1985 | Bose | 181/155 |
| 4,875,546 | A | 10/1989 | Krnan | 181/160 |
| 5,471,019 | A | 11/1995 | Maire | 181/156 |
| 5,729,605 | A * | 3/1998 | Bobisuthi | |
| 6,160,896 | A * | 12/2000 | Macaluso | |
| 6,212,284 | B1 | 4/2001 | Puls | 381/345 |

FOREIGN PATENT DOCUMENTS

| | | |
|---|---|---|
| JP | 4301998 | 10/1992 |
| WO | WO 9508243 | 3/1995 |

* cited by examiner

*Primary Examiner*—Sinh Tran
*Assistant Examiner*—Dionne Pendleton
(74) *Attorney, Agent, or Firm*—Edward W. Goodman; Paul Im

(57) ABSTRACT

A loudspeaker includes an acoustical enclosure having an internal wall dividing the enclosure into first and second subchambers, an electro-acoustical transducer having a vibratable speaker cone mounted in an opening in the internal wall of the acoustical enclosure, an internal vent in the internal wall of the acoustical enclosure for pneumatically coupling the first and second subchambers, a first external vent in a wall of the first subchamber for pneumatically coupling the first subchamber to an exterior environment outside of the acoustical enclosure, and a second external vent in a wall of the second subchamber for pneumatically coupling the second subchamber to the exterior environment, a ratio of the acoustic masses of the internal vent to the the second external vent being approximately 3/1 to 7/1, and a ratio of the acoustic masses of the first external vent to the second external vent being approximately 15/1 to 30/1.

20 Claims, 4 Drawing Sheets

LOUDSPEAKER HAVING A DUAL CHAMBER ACOUSTICAL ENCLOSURE WITH TWO EXTERNAL VENTS AND ONE INTERNAL VENT

BACKGROUND OF THE INVENTION

The present invention relates generally to the field of loudspeakers, and more particularly, to a loudspeaker having a dual chamber acoustical enclosure having two external vents and one internal vent.

A common objective in designing loudspeaker systems is to improve acoustical performance in the operating band of the system and to minimize distortion caused by, among other things, loudspeaker cone excursions at frequencies at and below a lower cutoff frequency of the system.

In general, when a loudspeaker is energized, its electro-acoustic transducer diaphragm ("cone") reciprocates or vibrates at a frequency which varies with the signal input to the loudspeaker. When an unmounted or unbaffled loudspeaker is operated in a so-called "free air" mode, its cone exhibits large mechanical excursions as it approaches its resonant frequency, which produces significant acoustical distortion. In order to control this motion and thereby reduce the distortion level of the loudspeaker, it is customary to mount the loudspeaker in some form of housing or loudspeaker enclosure.

In its simplest form, this enclosure is a closed box with the loudspeaker mounted or suspended in an opening in one wall thereof. Such a loudspeaker system causes the large amplitudes of the loudspeaker cone excursions to occur at a different frequency, thus changing the resonant frequency of the loudspeaker relative to its resonant frequency in its "free air" mode of operation.

U.S. Pat. No. 4,549,631, issued to Amar G. Bose, discloses an acoustic suspension loudspeaker system that has an acoustical enclosure of rectangular cross-section with a baffle dividing the interior of the enclosure into first and second subchambers. The acoustical enclosure of the loudspeaker system disclosed by Bose is commonly referred to as a "bass reflex" enclosure. Each subchamber of this enclosure has a port tube ("vent") that couples the respective subchamber to the exterior environment outside of the enclosure. The dividing baffle carries a woofer. This type of acoustical enclosure can be thought of as a dual chamber acoustical enclosure having two "external" vents. Each external vent serves as a passive radiating means. More particularly, each external vent provides an acoustic mass that constitutes an extra reactance which can be used to tailor the frequency response of the loudspeaker system at the low end. A ported or vented system is characterized by a resonance (port resonance) at which the mass of air in the port (vent) reacts with the volume of air within the enclosure to create a resonance at which the excursion of the loudspeaker cone is minimized. The dual chamber acoustical enclosure provided with two external vents disclosed by Bose provides improved sensitivity at port resonance which results in an extension of the lower cutoff frequency of the loudspeaker system to a lower value, while also reducing loudspeaker cone excursions in the vicinity of the lower cutoff frequency of the loudspeaker system.

However, for bass reflex loudspeakers of the type disclosed in U.S. Pat. No. 4,549,631 (Bose) to achieve a flat bandpass response, a loudspeaker driver with a rather high magnetic efficiency is required, which is expensive. Moreover, bass reflex loudspeakers which utilize two subchambers having ports for directly acoustically coupling each of the respective subchambers to the exterior environment, tend to provide poor response for acoustic frequencies falling between the resonant frequencies of the two subchambers and their corresponding respective ports when the resonant frequencies of the two subchambers vary by more than a factor of 3 to 1.

U.S. Pat. No. 4,875,546, issued to Palo Krnan, discloses a two-chamber bass reflex type loudspeaker that overcomes the above-noted deficiency of the Bose loudspeaker system. In particular, the Krnan loudspeaker system exhibits good frequency response for frequencies between the resonant frequencies of the two subchambers of the two-chamber enclosure, even when these resonant frequencies are separated by a factor of up to 10 to 1. The Krnan loudspeaker system includes a first subchamber that is pneumatically and acoustically coupled with the second subchamber via a first port (vent) that is sized to enclose a first acoustic mass of air while one of the subchambers is pneumatically and acoustically coupled with the outside environment via a second port (vent) that is sized to enclose a second acoustic mass of air. By properly constructing the first and second subchambers and first and second ports, the acoustical enclosure will operate as an acoustical bandpass filter in which high frequency distortion components such as those generated by diaphragm excursions of the transducer (speaker cone) will be acoustically attenuated.

Although the Krnan loudspeaker system described above does overcomes some of the problems inherent with electrical filtering via crossover networks, and does exhibit better performance over a broader operating band than the Bose loudspeaker system described above, it still has significant drawbacks and shortcomings. More particularly, the efficiency of the Krnan loudspeaker system is less than desirable, and the distortion products generated in the vicinity of the lower cutoff frequency are greater than is desirable.

It should be mentioned that Japanese Published Application Number 4-301998, naming Kinihiko Tamura as the inventor, discloses a dual-chamber loudspeaker system that features a "triple-vented" acoustical enclosure, with two "external" vents that pneumatically and acoustically couple respective subchambers to the exterior environment, and one "internal" vent that pneumatically and acoustically couples the first and second subchambers of the enclosure to one another. This dual-chamber, triple-vented loudspeaker system is a low band (i.e., bass) loudspeaker system. The internal vent is specifically designed and used to minimize distortion due to loudspeaker cone excursions at frequencies lower than the resonant frequency (i.e., it sharpens the upper cutoff frequency of the bass speaker), but does not contribute to acoustical output within the normal operating band. In fact, Tamura teaches that even in the narrow low frequency band of interest in his system, the internal vent actually acts as a bypass circuit whose effect is to reduce the acoustical output from the external vents, as well as to reduce the level of the distortion.

Based on the above and foregoing, it can be appreciated that there presently exists a need in the art for a loudspeaker system having an acoustical enclosure that overcomes the above-discussed drawbacks and shortcomings of the presently available technology. The present invention fulfills this need in the art.

SUMMARY OF THE INVENTION

The present invention encompasses a loudspeaker that includes an acoustical enclosure that has an internal wall that divides the enclosure into first and second subchambers, an electro-acoustical transducer having a vibratable speaker cone mounted in an opening provided in the internal wall of the acoustical enclosure, an internal vent provided in the internal wall of the acoustical enclosure for pneumatically coupling the first and second subchambers, a first external vent provided in a wall of the first subchamber for pneumatically coupling the first subchamber to an exterior environment outside of the acoustical enclosure, and a second external vent provided in a wall of the second subchamber for pneumatically coupling the second subchamber to the exterior environment. In one embodiment, a ratio of the acoustic mass of the internal vent to the acoustic mass of the second external vent is in a range of approximately 3/1 to 7/1. In another embodiment, a ratio of the acoustic mass of the first external vent to the acoustic mass of the second external vent is in a range of approximately 15/1 to 30/1. In both embodiments, a ratio of the volume of the first subchamber to the volume of the second subchamber is in a range of approximately 0.3 to 2.5. In both embodiments, at least one of the internal and/or external vents can be substituted with a passive radiating element such as a drone cone.

BRIEF DESCRIPTION OF THE DRAWINGS

These and other objects, features, and advantages of the present invention will become readily apparent from the following detailed description read in conjunction with the accompanying drawings, in which.

DETAILED DESCRIPTION OF THE INVENTION

Figure 1:
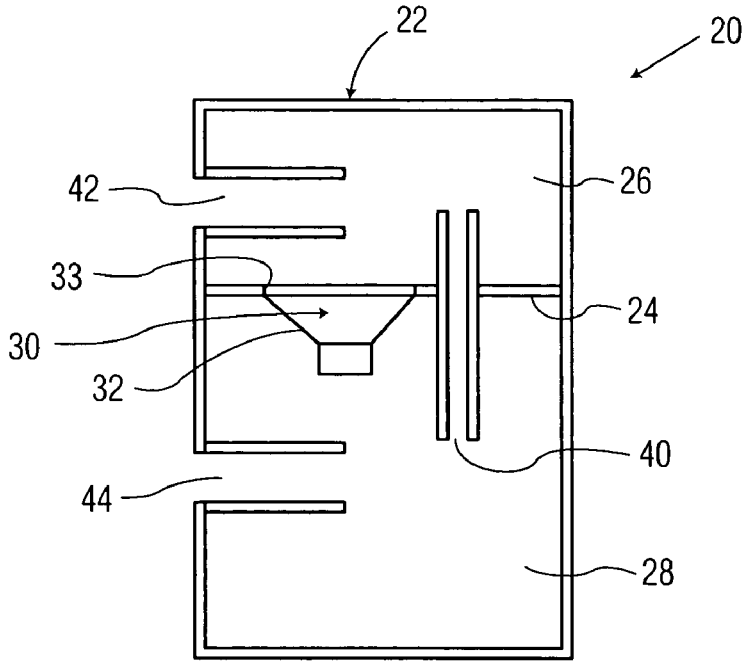
FIG. 1 is a schematic representation of a loudspeaker constructed in accordance with a first preferred embodiment of the present invention.

With reference now to FIG. 1, there can be seen a schematic representation of a loudspeaker 20 constructed in accordance with a first preferred embodiment of the present invention. The loudspeaker 20 includes a housing or acoustical enclosure 22 separated by a dividing wall or baffle 24 into a first chamber or subchamber 26 and a second chamber or subchamber 28. An electro-acoustic transducer or loudspeaker driver 30 that includes a speaker cone 32 is mounted in an opening 33 in the dividing wall 24, with a front surface of the speaker cone 32 in communication with the first subchamber 26 and a rear surface of the speaker cone 32 in communication with the second subchamber 28. The internal air volumes of both subchambers 26 and 28 are substantially reactive to the acoustic energy generated by the loudspeaker driver 30 in response to an electrical input signal. Preferably, the loudspeaker driver 30 and the opening 33 are sized so that the driver 30 completely fills the opening 33 so as to ensure that no air passes through the opening 33.

With continuing reference to FIG. 1, in accordance with the first preferred embodiment of the present invention, the acoustical enclosure 22 includes an internal vent 40 that pneumatically couples the first and second subchambers 26 and 28, an external vent 42 that pneumatically couples the first subchamber 26 with the exterior environment surrounding the loudspeaker 20, and an external vent 44 that pneumatically couples the second subchamber 28 with the exterior environment surrounding the loudspeaker 20. Thus, the acoustical enclosure 22 can be thought of as a dual-chamber, "triple-vented" enclosure.

In accordance with this first preferred embodiment of the present invention, the loudspeaker 20 is designed so that both of the external vents 42 and 44 significantly contribute to the overall acoustical output of the loudspeaker 20. In general, this is accomplished by appropriate selection of various parameters of the loudspeaker 20.

In particular, in accordance with the first preferred embodiment of the present invention, the ratio of the volumes of the first and second subchambers 26 and 28 is preferably in the range of 0.3 to 2.5, with the particular volume ratio selected being dependent upon the desired operating band (i.e., frequency band of the acoustical output) of the loudspeaker 20 and the selected resonant frequency of the loudspeaker driver 30.

In further accordance with the first preferred embodiment of the present invention, the ratio of the acoustic mass of the internal vent 40 to the acoustic mass of the external vent 44 is in the range of approximately 3/1 to 7/1, in order to achieve an appreciable improvement in the acoustical output of the loudspeaker 20 over a reasonably broad operating band, with the particular ratio selected being largely dependent upon the selected operating band and the selected resonant frequency of the loudspeaker driver 30.

The internal vent 40 and the external vents 42 and 44 can be embodied as port tubes or ducts, e.g., port tubes of the type described in U.S. Pat. No. 4,875,546, issued to Palo Krnan, the disclosure of which is herein incorporated by reference, in its entirety. As is described in greater detail in the '546 patent, a port tube is an elongated hollow member open at both ends and sized to enclose a selected acoustic mass of air. Preferably, although not necessarily, each port tube is tubular. Alternatively, a passive radiating element, e.g., a drone cone, can be substituted for any one or more of the internal and external vents, with the acoustic mass of each passive radiating element being selected so that its mass can take the place of the acoustic mass of air enclosed by the vent that it is replacing.

Figure 2:
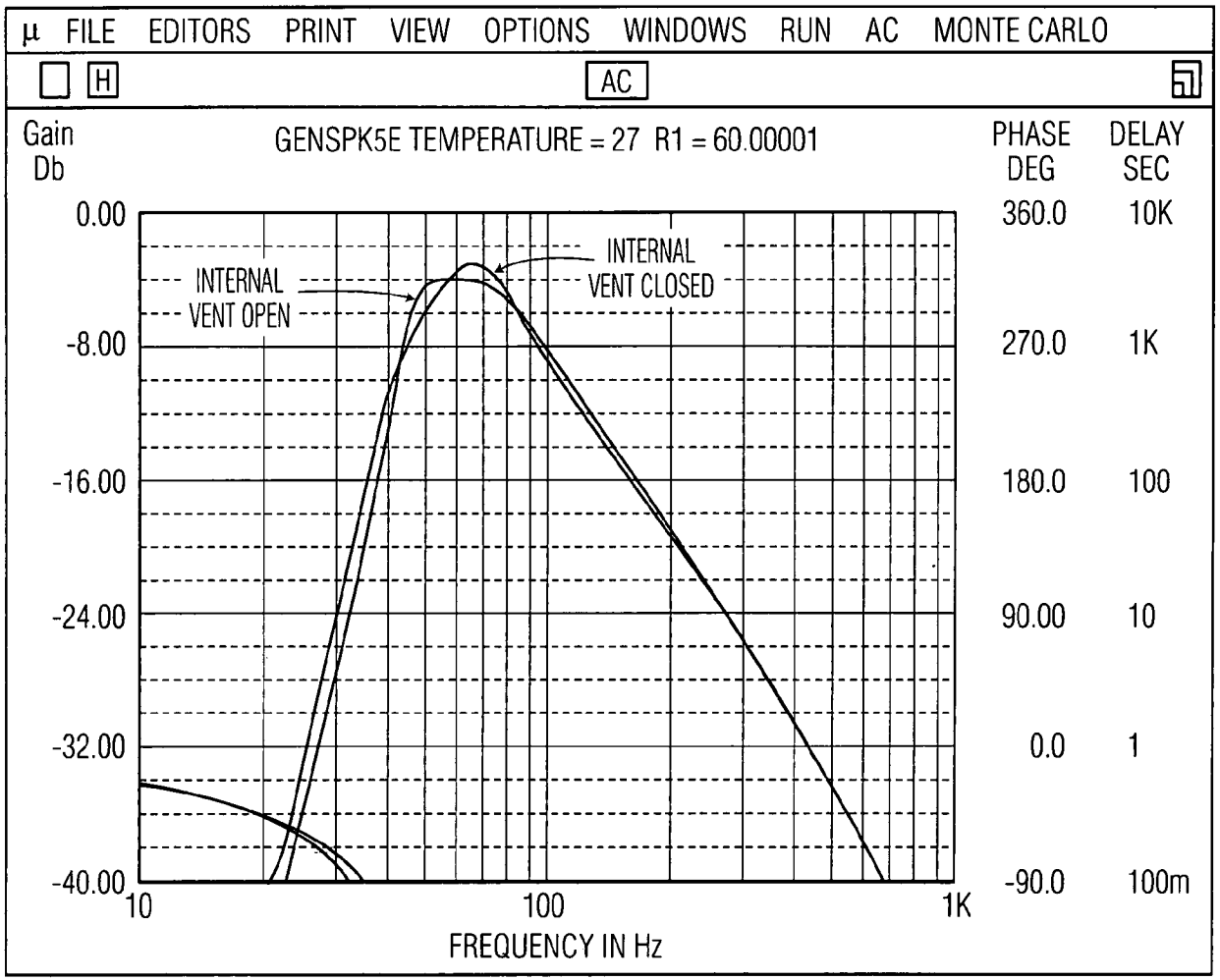
FIG. 2 is a graph plotting the frequency response of the loudspeaker depicted in FIG. 1 with the internal vent open and with the internal vent closed.

With reference now to FIG. 2, there can be seen a graph plotting the frequency response of the loudspeaker 20 depicted in FIG. 1 with the internal vent 40 open and with the internal vent 40 closed. As can be readily seen, with the internal vent 40 open, an appreciable improvement in the acoustical output of the loudspeaker 20 is achieved.

Figure 3:
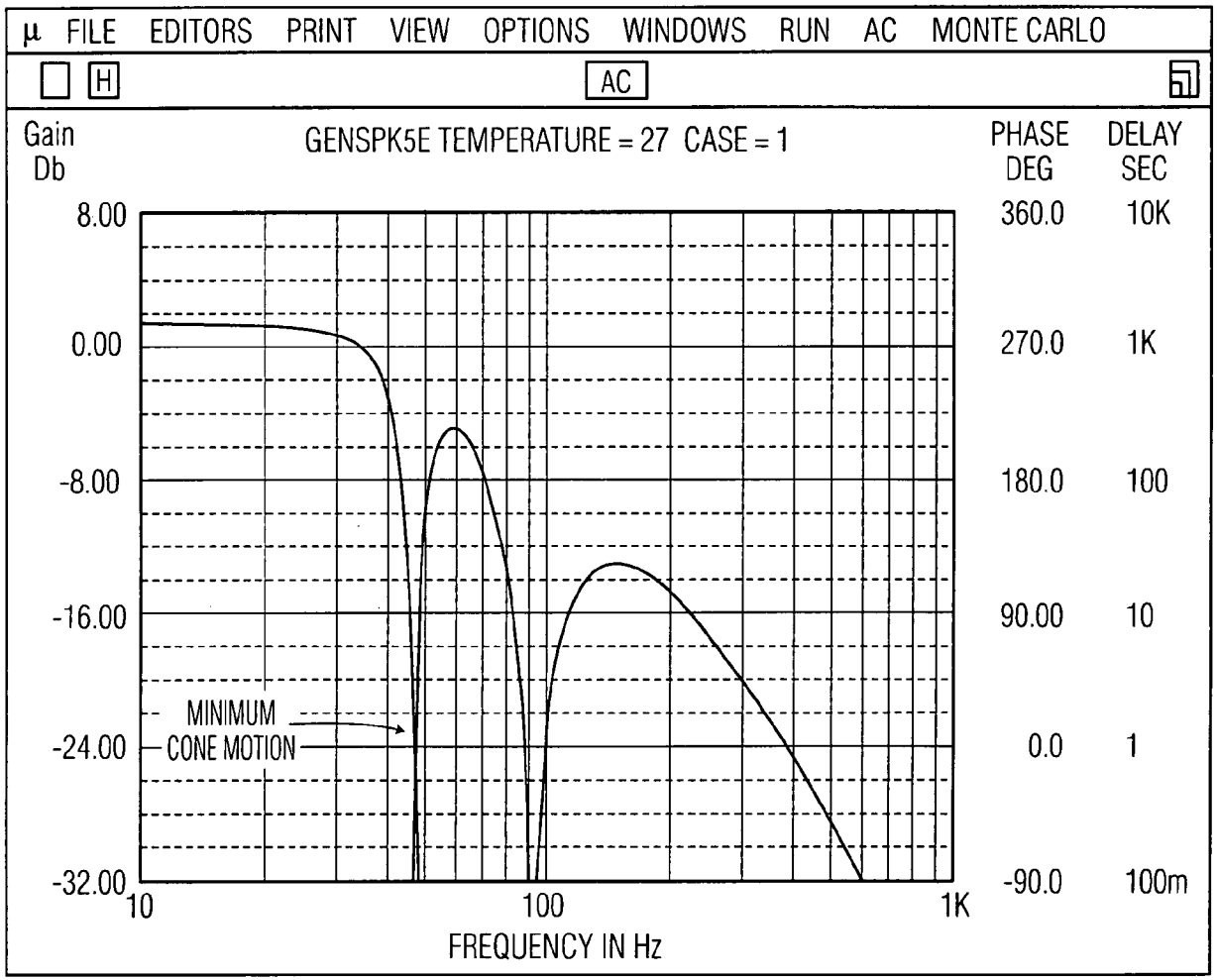
FIG. 3 is a graph plotting the relative cone amplitude versus frequency for the loudspeaker depicted in FIG. 1 (with a 45 Hz lower cutoff frequency)

With reference now to FIG. 3, there can be seen a graph plotting the relative speaker cone amplitude versus frequency for the loudspeaker 20 depicted in FIG. 1 (with a 45 Hz lower cutoff frequency). As can be readily seen, the dual-chamber, triple-vented acoustical enclosure results in a high impedance to speaker cone motion in the vicinity of the lower cutoff frequency (in this case, 45 Hz), thereby resulting in minimum speaker cone motion in the vicinity of the lower cutoff frequency, and, in turn, significantly reducing the distortion products caused by excursions of the speaker cone. In particular, the internal vent 40 introduces an additional acoustic mass that causes an additional resonating network to occur, which results in a high impedance to speaker cone motion in the vicinity of the lower cutoff frequency.

Figure 4:
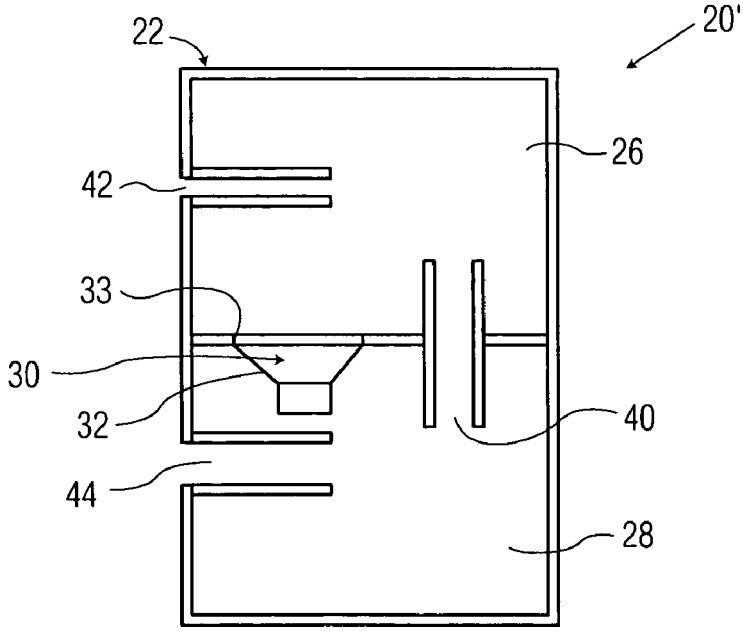
FIG. 4 is a schematic representation of a loudspeaker constructed in accordance with a second preferred embodiment of the present invention.

With reference now to FIG. 4, there can be seen a schematic representation of a loudspeaker 20' constructed in accordance with a second preferred embodiment of the present invention. This embodiment is the same as the first preferred embodiment, except that, in accordance with this second preferred embodiment of the present invention, the loudspeaker 20' is designed so that the internal vent 40 and one of the external vents 42 and 44 significantly contribute to the overall acoustical output of the loudspeaker 20'. In general, this is accomplished by appropriate selection of various parameters of the loudspeaker 20'.

In particular, in accordance with the second preferred embodiment of the present invention, the ratio of the volumes of the first and second subchambers 26 and 28 is preferably in the range of 0.3 to 2.5, with the particular volume ratio selected being dependent upon the desired operating band (i.e., frequency band of the acoustical output) of the loudspeaker 20' and the selected resonant frequency of the loudspeaker driver 30.

In further accordance with the second preferred embodiment of the present invention, the ratio of the acoustic mass of the external vent 42 to the acoustic mass of the external vent 44 is in the range of approximately 15/1 to 30/1, in order to achieve an appreciable improvement in the acoustical output of the loudspeaker 20' over a reasonably broad operating band, with the particular ratio selected being largely dependent upon the selected operating band and the selected resonant frequency of the loudspeaker driver 30.

Figure 5:
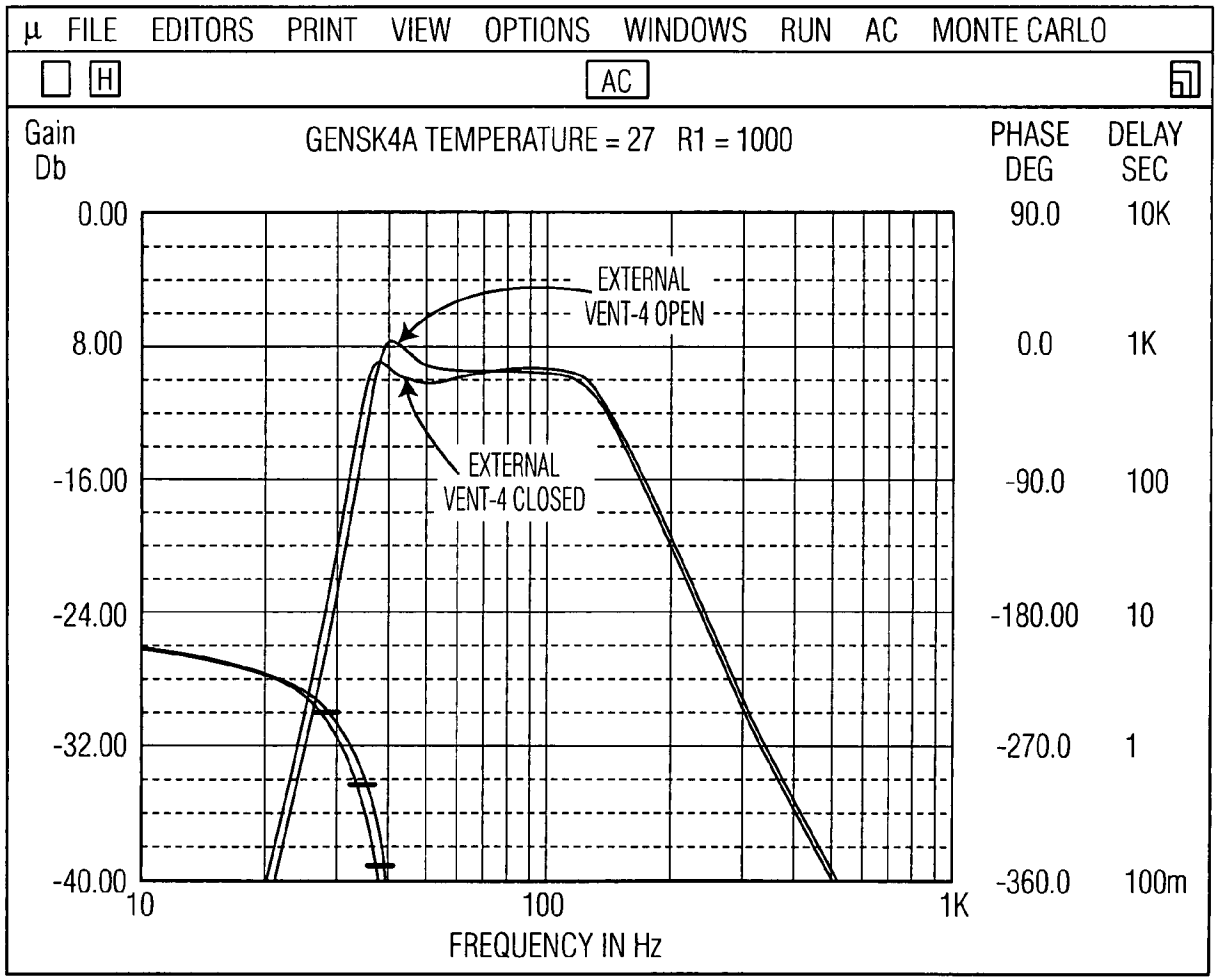
FIG. 5 is a graph plotting the frequency response of the loudspeaker depicted in FIG. 4 with external vent 44 open and with the external vent 44 closed.

With reference now to FIG. 5, there can be seen a graph plotting the frequency response of the loudspeaker 20' depicted in FIG. 4 with external vent 42 open and with the external vent 42 closed. As can be readily seen, with the external vent 44 open, an appreciable improvement in the acoustical output of the loudspeaker 20' is achieved.

It should be noted that in comparison with the dual chamber acoustical enclosure provided with two external vents disclosed by Bose in U.S. Pat. No. 4,549,631, the disclosure of which is incorporated herein by reference, in its entirety, the triple-vented acoustical enclosure of either preferred embodiment of the present invention reduces the magnetic efficiency requirement for the loudspeaker driver by approximately one-half, thereby significantly reducing the cost of the speaker.

Further, the triple-vented acoustical enclosure of either preferred embodiment of the present invention exhibits improved acoustical output over a broad operating band, and produces less distortion products below the lower cutoff frequency, in comparison with the dual chamber acoustical enclosure provided with two external vents disclosed by Bose in U.S. Pat. No. 4,549,631.

It should also be noted that in comparison with the dual chamber acoustical enclosure provided with one internal vent and one external vent described in U.S. Pat. No. 4,875,546, issued to Palo Krnan, the triple-vented acoustical enclosure of either embodiment of the present invention exhibits improved acoustical output over a broad operating band, i.e., the speaker disclosed by Krnan is about 2 dB less efficient that the speaker of the present invention.

It should also be noted that in comparison with the dual chamber, triple-vented acoustical enclosure described in Japanese Published Application Number 4-301998, naming Kinihiko Tamura as the inventor, the triple-vented acoustical enclosure of either embodiment of the present invention exhibits improved acoustical output over a broad operating band, i.e., the speaker disclosed by Tamura is a narrow band (i.e., low frequency band) loudspeaker system that is not designed to improve acoustical output over a broad frequency band.

Further, the internal vent in the Tamura enclosure is specifically designed and used to minimize distortion due to loudspeaker cone excursions at frequencies lower than the resonant frequency (i.e., it sharpens the upper cutoff frequency of the bass speaker), but does not contribute to acoustical output within the normal operating band. In fact, Tamura teaches that even in the narrow low frequency band of interest in his system, the internal vent actually acts as a bypass circuit whose effect is to reduce the acoustical output from the external vents, as well as to reduce the level of the distortion.

Although the present invention has been described hereinabove with respect to two presently preferred embodiments thereof, it should be appreciated that many alternative embodiments, variations and/or modifications of the basic inventive concepts taught herein that may become apparent to those having ordinary skill in the pertinent art will still fall within the spirit and scope of the present invention as defined in the appended claims.

What is claimed is:

1. A loudspeaker, comprising:

an acoustical enclosure that has an internal wall that divides the enclosure into first and second subchambers, the internal wall being provided with an opening;

an electro-acoustical transducer having a vibratable speaker cone, the electro-acoustical transducer being mounted in the opening provided in the internal wall of the acoustical enclosure;

an internal vent provided in the internal wall of the acoustical enclosure for pneumatically coupling the first and second subchambers;

a first external vent provided in a wall of the first subchamber for pneumatically coupling the first subchamber to an exterior environment outside of the acoustical enclosure;

a second external vent provided in a wall of the second subchamber for pneumatically coupling the second subchamber to the exterior environment;

wherein a ratio of an acoustic mass of the internal vent to an acoustic mass of the second external vent is in a range of approximately 3/1 to 7/1.

2. The loudspeaker as set forth in claim 1, wherein the loudspeaker is a broadband loudspeaker.

3. The loudspeaker as set forth in claim 1, wherein a ratio of a first volume of the first subchamber to a second volume of the second subchamber is in a range of approximately 0.3 to 2.5.

4. The loudspeaker as set forth in claim 1, wherein the speaker cone has a front surface in communication with the first subchamber, and a rear surface in communication with the second subchamber.

5. The loudspeaker as set forth in claim 3, wherein the speaker cone has a front surface in communication with the first subchamber, and a rear surface in communication with the second subchamber.

6. A loudspeaker, comprising:

an acoustical enclosure that has an internal wall that divides the enclosure into first and second subchambers, the internal wall being provided with an opening;

an electro-acoustical transducer having a vibratable speaker cone, the electro-acoustical transducer being mounted in the opening provided in the internal wall of the acoustical enclosure;

an internal vent provided in the internal wall of the acoustical enclosure for pneumatically coupling the first and second subchambers;

a first external vent provided in a wall of the first subchamber for pneumatically coupling the first subchamber to an exterior environment outside of the acoustical enclosure;

a second external vent provided in a wall of the second subchamber for pneumatically coupling the second subchamber to the exterior environment;

wherein a ratio of an acoustic mass of the first external vent to an acoustic mass of the second external vent is in a range of approximately 15/1 to 30/1.

7. The loudspeaker as set forth in claim 6, wherein the loudspeaker is a broadband loudspeaker.

8. The loudspeaker as set forth in claim 6, wherein a ratio of a first volume of the first subchamber to a second volume of the second subchamber is in a range of approximately 0.3 to 2.5.

9. The loudspeaker as set forth in claim 6, wherein the speaker cone has a front surface in communication with the first subchamber, and a rear surface in communication with the second subchamber.

10. The loudspeaker as set forth in claim 8, wherein the speaker cone has a front surface in communication with the first subchamber, and a rear surface in communication with the second subchamber.

11. A loudspeaker, comprising:

an acoustical enclosure that has an internal wall that divides the enclosure into first and second subchambers, the internal wall being provided with an opening;

an electro-acoustical transducer having a vibratable speaker cone, the electro-acoustical transducer being mounted in the opening provided in the internal wall of the acoustical enclosure;

a first means provided in the internal wall of the acoustical enclosure for acoustically coupling the first and second subchambers;

a second means provided in a wall of the first subchamber for acoustically coupling the first subchamber to an exterior environment outside of the acoustical enclosure;

a third means provided in a wall of the second subchamber for acoustically coupling the second subchamber to the exterior environment;

wherein a ratio of an acoustic mass of the first means to an acoustic mass of the third means is in a range of approximately 3/1 to 7/1.

12. The loudspeaker as set forth in claim 11, wherein the first means, second means, and third means have respective first, second and third acoustic masses.

13. The loudspeaker as set forth in claim 11, wherein a ratio of a volume of the first subchamber to a volume of the second subchamber is in a range of approximately 0.3 to 2.5.

14. The loudspeaker as set forth in claim 11, wherein the speaker cone has a front surface in communication with the first subchamber, and a rear surface in communication with the second subchamber.

15. The loudspeaker as set forth in claim 13, wherein the speaker cone has a front surface in communication with the first subchamber, and a rear surface in communication with the second subchamber.

16. A loudspeaker, comprising:

an acoustical enclosure that has an internal wall that divides the enclosure into first and second subchambers, the internal wall being provided with an opening;

an electro-acoustical transducer having a vibratable speaker cone, the electro-acoustical transducer being mounted in the opening provided in the internal wall of the acoustical enclosure;

a first means provided in the internal wall of the acoustical enclosure for acoustically coupling the first and second subchambers;

a second means provided in a wall of the first subchamber for acoustically coupling the first subchamber to an exterior environment outside of the acoustical enclosure;

a third means provided in a wall of the second subchamber for acoustically coupling the second subchamber to the exterior environment;

wherein a ratio of an acoustic mass of the second means to an acoustic mass of the third means is in a range of approximately 15/1 to 30/1.

17. The loudspeaker as set forth in claim 16, wherein the first means, second means, and third means are respective first, second, and third acoustic masses.

18. The loudspeaker as set forth in claim 16, wherein a ratio of a volume of the first subchamber to a volume of the second subchamber is in a range of approximately 0.3 to 2.5.

19. The loudspeaker as set forth in claim 16, wherein the speaker cone has a front surface in communication with the first subchamber, and a rear surface in communication with the second subchamber.

20. The loudspeaker as set forth in claim 18, wherein the speaker cone has a front surface in communication with the first subchamber, and a rear surface in communication with the second subchamber.

* * * * *